US011306432B2

(12) United States Patent
Hermes

(10) Patent No.: US 11,306,432 B2
(45) Date of Patent: Apr. 19, 2022

(54) HMPE FIBER WITH IMPROVED BENDING FATIGUE PERFORMANCE

(71) Applicant: HONEYWELL INTERNATIONAL INC., Morris Plains, NJ (US)

(72) Inventor: John Hermes, Colonial Heights, VA (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 116 days.

(21) Appl. No.: 16/667,290

(22) Filed: Oct. 29, 2019

(65) Prior Publication Data

US 2020/0141054 A1 May 7, 2020

Related U.S. Application Data

(60) Provisional application No. 62/756,061, filed on Nov. 5, 2018.

(51) Int. Cl.
*D07B 1/02* (2006.01)
*D02G 3/02* (2006.01)

(52) U.S. Cl.
CPC ..... *D07B 1/025* (2013.01); *D02G 3/02* (2013.01)

(58) Field of Classification Search
CPC ..... D07B 1/025; D02G 3/02
See application file for complete search history.

(56) References Cited

U.S. PATENT DOCUMENTS

| | | | |
|---|---|---|---|
| 4,584,347 | A | 4/1986 | Harpell et al. |
| 5,749,214 | A | 5/1998 | Cook |
| 5,852,926 | A | 12/1998 | Breedlove |
| 6,969,553 | B1 | 11/2005 | Tam et al. |

(Continued)

FOREIGN PATENT DOCUMENTS

| | | |
|---|---|---|
| CN | 201605478 | 10/2010 |
| CN | 105133177 | 12/2015 |

(Continued)

OTHER PUBLICATIONS

Weis et al., "Use of High Strength Fibre Ropes in Multi-rope Kinematic Robot Systems," Cable-Driven Parallel Robots, Mechanisms and Machine Science, vol. 12., Springer, pp. 185-199, Berlin/Heidelberg, Germany (2012).

*Primary Examiner* — Shaun R Hurley
(74) *Attorney, Agent, or Firm* — Roberts & Roberts, LLP; Richard S. Roberts, Jr.

(57) ABSTRACT

Provided are continuous filament-based elongate bodies having improved durability and bending fatigue performance. The elongate bodies are formed from a plurality of fibers where at least one component fiber is a multifilament ultra-high molecular weight polyolefin fiber having a filament intrinsic viscosity ($IV_f$) of from 15 dl/g to about 45 dl/g when measured in decalin at 135° C., wherein said at least one multifilament ultra-high molecular weight polyolefin fiber has a tenacity of at least 32 g/denier, a denier of greater than 800, and a denier per filament of greater than 2.0. The high tenacity combined with high fiber denier and high filament denier (dpf) enhances the cyclic bend over sheave (CBOS) durability when the elongate body is incorporated in a multi-fiber construction such as a rope.

20 Claims, 2 Drawing Sheets

(56) References Cited

U.S. PATENT DOCUMENTS

| | | | | |
|---|---|---|---|---|
| 7,344,668 | B2 | 3/2008 | Tam et al. | |
| 7,370,395 | B2 | 5/2008 | Tam | |
| 7,638,191 | B2 | 12/2009 | Tam et al. | |
| 7,736,561 | B2 | 6/2010 | Tam et al. | |
| 8,444,898 | B2 | 5/2013 | Tam et al. | |
| 8,506,864 | B2 | 8/2013 | Tam et al. | |
| 8,747,715 | B2 | 6/2014 | Tam et al. | |
| 8,889,049 | B2 | 11/2014 | Tam et al. | |
| 9,169,581 | B2 | 10/2015 | Tam et al. | |
| 9,365,953 | B2 | 6/2016 | Tam et al. | |
| 9,556,537 | B2 | 1/2017 | Tam et al. | |
| 9,765,447 | B2 | 9/2017 | Tam et al. | |
| 9,834,872 | B2 * | 12/2017 | Tam | D07B 1/025 |
| 2003/0207074 | A1 | 11/2003 | Ohta et al. | |
| 2004/0069132 | A1 | 4/2004 | Knudsen et al. | |
| 2006/0213175 | A1 | 9/2006 | Smith et al. | |
| 2007/0154707 | A1 * | 7/2007 | Simmelink | F41H 5/0478 428/364 |
| 2007/0202331 | A1 | 8/2007 | Davis et al. | |
| 2009/0165637 | A1 | 7/2009 | Bosman et al. | |
| 2009/0260510 | A1 | 10/2009 | Bosman | |
| 2010/0286728 | A1 | 11/2010 | Simmelink et al. | |
| 2012/0067020 | A1 | 3/2012 | Paddock et al. | |
| 2013/0225022 | A1 * | 8/2013 | Tam | D04H 13/00 442/60 |
| 2014/0000233 | A1 | 1/2014 | Chou et al. | |
| 2014/0190343 | A1 | 7/2014 | Tam et al. | |
| 2015/0152593 | A1 * | 6/2015 | Darda | D07B 1/025 87/3 |
| 2016/0122919 | A1 * | 5/2016 | Wagner | D04C 1/12 87/8 |
| 2018/0016710 | A1 * | 1/2018 | Tam | D04H 13/00 |
| 2019/0194844 | A1 * | 6/2019 | Fukushima | D01F 6/04 |

FOREIGN PATENT DOCUMENTS

| | | |
|---|---|---|
| EP | 3202702 | 8/2017 |
| JP | 2001303358 | 10/2001 |
| WO | 2014064157 | 5/2014 |
| WO | 2016069472 | 5/2016 |
| WO | 2017060461 | 4/2017 |

* cited by examiner

HMPE FIBER WITH IMPROVED BENDING FATIGUE PERFORMANCE

CROSS-REFERENCE TO RELATED APPLICATION

This application claims the benefit of U.S. Provisional Application Ser. No. 62/756,061, filed on Nov. 5, 2018, the disclosure of which is incorporated by reference herein in its entirety.

BACKGROUND

Technical Field

This technology relates to improvements in ropes, and in particular to high tenacity synthetic ropes having improved durability and bending fatigue performance.

Description of the Related Art

Synthetic fiber ropes have been used in a variety of applications, including various marine applications. One type of rope that has excellent properties is rope made from high modulus polyolefin fibers and/or yarns. High tenacity polyolefin fibers, such as SPECTRA® extended chain polyethylene fibers from Honeywell International Inc., are known to be particularly useful in marine applications due to their high strength (15 times stronger than steel by weight), light weight (they are light enough to float (0.97 g/cc specific gravity)), hydrophobicity, corrosion resistance, excellent fungal growth resistance, excellent abrasion resistance, excellent flex and bending fatigue performance, low coefficient of friction and their very good ultraviolet radiation resistance, which makes them very durable for extended use marine applications.

With particular regard to their high strength, fibers formed from ultra-high molecular weight polyethylene (UHMW PE) are known to possess excellent tensile properties such as tenacity, tensile modulus and energy-to-break. The term "tenacity" refers to the tensile stress expressed as force (grams) per unit linear density (denier) of an unstressed specimen as measured by ASTM D2256. The term "initial tensile modulus" refers to the ratio of the change in tenacity, expressed in grams-force per denier (g/d) to the change in strain, expressed as a fraction of the original fiber/tape length (in/in), and as used herein, the terms "initial tensile modulus", "tensile modulus" and "modulus" mean the modulus of elasticity as measured by ASTM 2256 for a fiber.

Such high tenacity fibers are typically made by a "gel spinning" process, which is also referred to as "solution spinning." In this type of process, a solution of ultra-high molecular weight polyethylene (UHMW PE) and a solvent is formed, followed by extruding the solution through a multi-orifice spinneret (having for example, 10 to 3000 spinholes) to form solution filaments (one filament being formed per spinhole), cooling the solution filaments into gel filaments, and extracting the solvent to form dry filaments. These dry filaments are grouped into bundles which are referred to in the art as either "fibers" or "yarns." The fibers/yams are then stretched (drawn) up to a maximum drawing capacity to increase their tenacity.

The preparation of high strength polyethylene filaments and/or multi-filament fibers/yarns has been described, for example, in U.S. Pat. Nos. 4,413,110; 4,536,536; 4,551,296; 4,663,101; 5,006,390; 5,032,338; 5,578,374; 5,736,244; 5,741,451; 5,958,582; 5,972,498; 6,448,359; 6,746,975; 6,969,553; 7,078,099; 7,344,668, 8,444,898, 8,506,864; 8,747,715; 8,889,049; 9,169,581; 9,365,953 and 9,556,537, all of which are incorporated herein by reference to the extent consistent herewith. Each of these patents teaches incremental improvements in UHMW PE processing technology and illustrates the great difficulty in improving the tensile properties of UHMW PE fibers. For example, while the tenacity and tensile modulus of UHMW PE fibers are increased by drawing the fibers, they can only be stretched to a certain extent without breaking. The maximum amount that a fiber can be stretched, and thus the maximum tenacity that can be achieved for a particular fiber type, depends on several factors, including both improved raw materials and processing capabilities.

To increase fiber tenacity, the polyethylene solution and its precursors (i.e., the polymer and the solvent forming the solution) must have certain properties, such as a high intrinsic viscosity ("IV"), and must be made in a particular manner. For example, U.S. Pat. No. 8,444,898 teaches processes for producing high tenacity fibers by a specialized process that limits the time that a fiber forming polymer/solvent mixtures is subjected to extreme processing conditions inside an extruder, which degrade the polymer. This process is distinguished from other methods that require more residence time in an extruder, which reduces the maximum achievable fiber tenacity due to associated polymer degradation within the extruder. U.S. Pat. No. 8,747,715 teaches a process for producing high tenacity polyethylene yarns wherein fibers are highly oriented to form a product having a tenacity of greater than about 45 g/d and a tensile modulus of greater than about 1400 g/d. The process takes steps to maintain polymer intrinsic viscosity so that fibers are fabricated having a fiber IV of greater than about 19 dl/g and tenacity of greater than about 45 g/d. These are just two methods that exemplify the significant investment in science and technology that goes into even incremental improvements in the tensile properties of polyethylene fibers.

Ropes formed from high strength polyethylene fibers are known and have been used, for example, in applications that require superior bending fatigue resistance. See, for example, U.S. pre-grant publications 2007/0202328 and 2007/0202331, both commonly-owned by Honeywell International Inc., which teach ropes that have good bending fatigue performance when repeatedly bent over sheaves, pulleys or posts in marine applications. Despite the existing high performance of such ropes, there is an ongoing need for products having improved properties and performance. In particular, there is an ongoing need in the art for synthetic ropes that experience greater long term durability when they are subjected to such repeated bending over sheaves, particularly when employed in industrial heavy lifting applications, and a need exists to improve the fatigue life of high performance synthetic ropes. In particular, the need exists to improve the cyclic bend over sheave (CBOS) performance of ropes made from high performance polyolefin fibers and yarns. The present technology provides a solution to this need in the art.

In this regard, it is known that fiber orienting during the fiber manufacturing process will increase fiber tenacity by subjecting the fiber to heat and tension under carefully controlled conditions, as is conventionally known in the art. In addition to increasing fiber tenacity, orienting (i.e., stretching; drawing) of a fiber also causes it to become thinner. In a single multifilament fiber which comprises a combination of a plurality of smaller filaments, orienting of the fiber correspondingly causes a thinning of each of the individual component filaments that form the fiber. In the textile arts, a common measure of the size of a fiber/yarn is its "denier" which is a unit of linear density equal to the mass in grams per 9000 meters of fiber/yarn. A decrease in fiber denier, as well as a decrease in the denier of the filaments forming a fiber, makes it more susceptible to fracture. This reduction in fiber/filament denier also makes them more susceptible to bending fatigue, which is a common problem in applications where elongate bodies, such as ropes formed from fibers, are typically passed over one or more sheaves. Accordingly, in the context of the present disclosure, each of the fiber tenacity, fiber denier and denier per filament are properties of particular importance because the fibers are particularly intended for use in the fabrication of ropes for heavy lifting applications, which are applications that require substantial fiber strength, resistance to axial breakage and an ability to withstand bending over time without breaking.

In order to produce elongate bodies useful in application demanding such premium strength properties and bending fatigue resistance, the bodies must incorporate fibers having a balance of physical properties that is not currently available in known fibers. Particularly, to achieve the objectives of this disclosure, it has been discovered that the elongate bodies must incorporate one or more ultra-high molecular weight polyolefin fibers having a combination of a filament intrinsic viscosity ($IV_f$) of from 15 dl/g to about 45 dl/g when measured in decalin at 135° C., a tenacity of at least 32 g/denier, a denier of greater than 800, and a denier per filament of greater than 2.0, preferably wherein the product of the denier per filament of said filaments multiplied by the $IV_f$ of said filaments is at least 75.0, preferably at least 75.0 up to 110.0, and wherein the ratio of $IV_f$ to denier per filament is from 4.0:1 up to 8.0:1. Such is accomplished herein by modifying known fiber/filament manufacturing techniques to fabricate elongate bodies incorporating one or more fibers that possess these properties to improve fiber/filament quality.

SUMMARY

The present disclosure provides multi-fiber elongate bodies, such as ropes, formed from fibers having a unique relationship of intrinsic viscosity, denier per filament and tenacity, which have unexpectedly achieved enhanced bending fatigue resistance of the elongate bodies, meeting the needs in the art.

Particularly, the disclosure provides an elongate body comprising a plurality of fibers, wherein at least one of said fibers comprises a multifilament ultra-high molecular weight polyolefin fiber having a filament intrinsic viscosity ($IV_f$) of from 15 dl/g to about 45 dl/g when measured in decalin at 135° C., wherein said at least one multifilament ultra-high molecular weight polyolefin fiber has a tenacity of at least 32 g/denier, a denier of greater than 800, and a denier per filament of greater than 2.0.

Also provided is an elongate body comprising at least one multifilament fiber that comprises an ultra-high molecular weight polyolefin fiber formed from a plurality of ultra-high molecular weight polyolefin filaments, said ultra-high molecular weight polyolefin filaments having a filament intrinsic viscosity ($IV_f$) of from 15 dl/g to about 45 dl/g when measured in decalin at 135° C., wherein said multifilament ultra-high molecular weight polyolefin fiber has a denier of greater than 800 and wherein each of the filaments of said multifilament ultra-high molecular weight polyolefin fiber has a denier of at least 2.0, wherein the product of the denier per filament of said filaments multiplied by the $IV_f$ of said filaments is from 75.0 to 110.0.

Still further provided is a method of making an elongate body comprising the steps of:

a) providing a plurality of fibers, wherein at least one of said fibers comprises a multifilament ultra-high molecular weight polyolefin fiber having a filament intrinsic viscosity ($IV_f$) of from 15 dl/g to about 45 dl/g when measured in decalin at 135° C., wherein said at least one multifilament ultra-high molecular weight polyolefin fiber has a tenacity of less than 32 g/denier, a denier of greater than 800, and a denier per filament of greater than 2.0.

b) stretching each multifilament fiber to thereby increase the tenacity of the fibers to at least 32 g/denier, wherein the denier per filament remains greater than 2.0;

c) optionally coating at least a portion of each fiber with either a thermoplastic resin or an oil;

d) twisting, entangling or braiding the fibers to form an elongate body structure; and e) optionally heating and stretching the elongate body structure to heat set the fibers of said elongate body.

DETAILED DESCRIPTION

Figure 1:
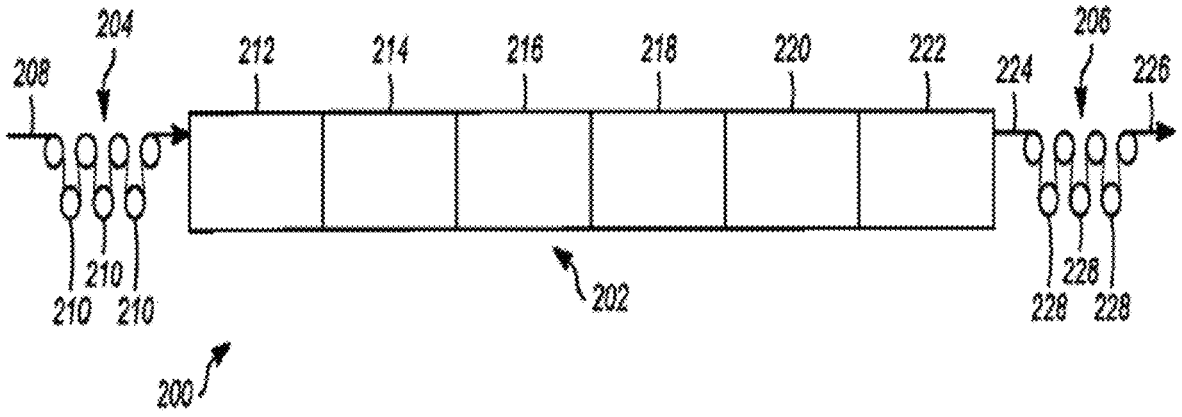
FIG. 1 illustrates an exemplary post-drawing process wherein a fiber is drawn by being passed in a single direction through a plurality of horizontally abutting ovens.

As used herein, a "fiber" is an elongate strand of a material, such as a strand of a polymeric material, the length dimension of which is much greater than the transverse dimensions of width and thickness. The fiber is preferably a long, continuous strand rather than a short segment of a strand referred to in the art as a "staple" or "staple fiber." As used herein, the term "elongate" has its ordinary and customary meaning of something having a shape that is much longer than it is wide. In the context of this disclosure an "elongate body" may be a strand comprising a single fiber or comprising multiple combined fibers, wherein multiple fibers may be combined, for example, by twisting, entangling, braiding or a combination thereof. An example of an elongate body comprising multiple fibers that are combined by twisting, entangling or braiding, or a combination thereof, is a rope, such as a braided rope.

The cross-sections of fibers for use in this disclosure may vary widely, and they may be circular, flat or oblong in cross-section. Thus the term "fiber" includes filaments, ribbons, strips and the like having regular or irregular cross-section, but it is preferred that the fibers have a substantially circular cross-section. A "strand" by its ordinary definition is a single, thin length of something, such as a thread or fiber. A single continuous filament fiber may be formed from just one filament or from multiple filaments. A fiber formed from just one filament is referred to herein as either a "single-filament" fiber or a "monofilament" fiber, and a fiber formed from a plurality of filaments is referred to herein as a "multifilament" fiber. Multifilament fibers as defined herein preferably include from 2 to about 3000 filaments, more preferably from 2 to 1000 filaments, still more preferably from 30 to 500 filaments, still more preferably from 40 to 500 filaments, still more preferably from about 40 filaments to about 360 filaments and most preferably from about 120 to about 240 filaments. Multifilament fibers are also often referred to in the art as filament bundles or a bundle of filaments. A bundled group of fibers may be referred to as a fiber bundle or a bundle of fibers. The definition of multifilament fibers herein also encompasses pseudo-monofilament fibers, which is a term of art describing multifilament fibers that are at least partially fused together and may look like monofilament fibers. As used herein, the term "yarn" is defined as a single continuous strand consisting of multiple fibers or filaments and is a term often used interchangeably with a multifilament fiber.

Provided herein are elongate bodies that comprise, consist or consist essentially of one or more polyolefin fibers or a combination of polyolefin and non-polyolefin fibers, wherein at least one of said polyolefin fibers forming the elongate body wherein at least one of said fibers is a multifilament ultra-high molecular weight polyolefin fiber having a filament intrinsic viscosity ($IV_f$) of from 15 dl/g to about 45 dl/g when measured in decalin at 135° C., wherein said at least one multifilament ultra-high molecular weight polyolefin fiber has a tenacity of at least 32 g/denier, a denier of greater than 800, and a denier per filament of greater than 2.0.

It is generally known that very high performance filaments and fibers having superior tensile properties are made by gel/solution spinning of ultra-high molecular weight polyolefins (UHMW PO), and in particular ultra-high molecular weight polyethylene (UHMW PE). Generally, "gel spinning" processes involve forming of a solution of spinning solvent and a polymer (such as UHMW PE) and a passing the solution through a spinneret to form a plurality of solution filaments that are grouped together to form a fiber (or yarn). These solution filaments are then cooled to form gel filaments. The spinning solvent must then be removed from the gel filaments to form an essentially dry multifilament fiber, which dry fiber is then oriented (i.e., stretched or drawn) to increase its tensile properties. It is also known to orient the filaments at the solution and gel stages to increase fiber properties. In general, higher fiber tensile properties are obtained from polyethylenes having higher intrinsic viscosities. The intrinsic viscosity of a polymer is a measure of the molecular weight of the polymer. Most solution/gel spinning methods used to form high strength fibers are known to cause some degradation of the polymer as the polymer is mixed with a solvent in an extruder and converted into a solution. Such degradation results in some loss of molecular weight, and thus a reduction of intrinsic viscosity. Accordingly, in typical UHMW PE filament/fiber fabrication methods, the initial intrinsic viscosity of the polymer raw material ($IV_0$) that is spun to form the filaments/fibers will be greater than the $IV_f$, which will in turn affect the maximum achievable tenacity of fibers formed therefrom.

Some methods, such as the method of U.S. Pat. Nos. 7,638,191 and 7,736,561, teach certain processing advantages to the intentional degradation of intrinsic viscosity. On the other hand, other methods such as those of U.S. Pat. Nos. 8,444,898, 8,506,864; 8,747,715; 8,889,049; 9,169,581; 9,365,953 and 9,556,537, teach certain benefits to maximizing molecular weight and intrinsic viscosity. U.S. Pat. Nos. 8,747,715; 9,365,953 and 9,556,537 specifically teach a method of making very high tenacity fibers, i.e., fibers having a tenacity of at least 45 g/d, by processing a UHMW PE powder raw material having a very high $IV_0$ of at least 30 dl/g. U.S. Pat. Nos. 8,444,898 and 8,506,864 teach that molecular weight degradation is minimized by minimizing the time that the UHMW PE polymer raw material is mixed with the spinning solvent in an extruder. In this regard, the initial steps of a conventional UHMW PE solution/gel spinning processes involve: (1) processing a UHMW PE powder and a spinning solvent in either an extruder or a combination of an extruder and a heated vessel to form a solution of the polymer and spinning solvent; (2) passing the solution through a spinneret (as previously stated) to form a solution fiber that includes a plurality of solution filaments; (3) cooling the solution fiber to form a gel fiber; (4) removing the spinning solvent by either extraction or evaporation to form an essentially dry, solid fiber; and then (5) stretching at least one of the solution yarn, the gel yarn and the dry yarn to form a final multi-filament fiber product.

For the purposes of this disclosure, it has been recognized that the desired fiber properties are achieved when the final fiber products have a filament/fiber intrinsic viscosity ($IV_f$) of 15 dl/g or more, preferably from 15 dl/g to about 45 dl/g (as measured in decalin at 135° C. according to the techniques of ASTM D1601). As such, the fibers of the present disclosure may be fabricated from any conventionally known solution or gel spinning process, provided that the method is improved to minimize degradation of the polymer molecular weight during fabrication multifilament ultra-high molecular weight polyolefin fibers such that the $IV_f$ is at least 15 dl/g, and more particularly, an $IV_f$ of from 15 dl/g to about 45 dl/g, as measured in decalin at 135° C. In the preferred embodiments, the filament/fiber fabrication methods of U.S. Pat. Nos. 8,444,898, 8,506,864; 8,747,715; 8,889,049; 9,169,581; 9,365,953 and 9,556,537 are most effective in achieving this objective and thus are most preferred for the fabrication of the UHMW PE fibers of this disclosure.

To form such fibers, steps should be taken to maintain the intrinsic viscosity of the UHMW PE polymer ($IV_0$) (as measured in decalin at 135° C. according to the techniques of ASTM D1601; units dl/g). As described in U.S. Pat. No. 9,169,581, effective steps include, for example, sparging the spinning solvent with nitrogen prior to mixing with the UHMW PE polymer, or sparging the polymer-solvent mixture and/or the polymer-solvent solution with nitrogen gas, which will reduce or entirely eliminate the presence of oxygen, which is known to cause shear induced chain scission. Nitrogen sparging, particularly at temperatures less than 290° C., promotes long chain branching rather than chain scission, thus retaining $IV_0$. Nitrogen sparging refers to bubbling nitrogen through the solvent/mixture/solution, preferably continuously, such as by continuously bubbling nitrogen through a slurry tank containing a solvent-polymer slurry that is to be added to an extruder for mixing. Nitrogen sparging in the slurry tank may take place, for example, at a rate of from about 2.4 liters/minute to about 23.6 liters/minute. However, any conventional sparging technique may be used. Other means of reducing or eliminating the presence of oxygen from the polymer-solvent mixture and/or solution during polymer processing should be similarly effective, such as the incorporation of an antioxidant into the polymer-solvent mixture and/or solution. The use of an antioxidant is taught in U.S. Pat. No. 7,736,561, which is commonly owned by Honeywell International Inc. In this embodiment, the concentration of the antioxidant should be sufficient to minimize the effects of adventitious oxygen but not so high as to react with the polymer. The weight ratio of the antioxidant to the solvent is preferably from about 10 parts per million to about 1000 parts per million. Most preferably, the weight ratio of the antioxidant to the solvent is from about 10 parts per million to about 100 parts per million. Useful antioxidants non-exclusively include hindered phenols, aromatic phosphites, amines and mixtures thereof. Preferred antioxidants include 2,6-di-tert-butyl-4-methyl-phenol, tetrakis [methylene(3,5-di-tert-butylhydroxyhydrocinnamate)]methane, tris(2,4-di-tert-butylphenyl) phosphite, octadecyl 3,5-di-tert-butyl-4-hyroxyhydrocinnamate, 1,3,5-tris(3,5-di-tert-butyl-4-hydroxybenzyl)-1,3,5-triazine-2,4,6(1H,3H,5H)-trione, 2,5,7,8 tetramethyl-2(4',8',12'-trimethyltridecyl)chroman-6-ol, and mixtures thereof. More preferably the antioxidant is 2,5,7,8 tetramethyl-2(4',8',12'-trimethyltridecyl)chroman-6-ol, commonly known as Vitamin E or α-tocopherol. Other additives may also be optionally added to the mix of polymer and solvent, such as processing aids, stabilizers, etc., as may be desirable to maintain polymer molecular weight and $IV_0$.

Polymer degradation may also be controlled during the initial stages of conventional gel spinning processes (i.e., (1) formation of a slurry; (2) heating the slurry to melt the polymer and to form a liquid mixture under conditions of intense distributive and dispersive mixing to thereby reduce the domain sizes of molten polymer and solvent in the mixture to microscopic dimensions; and (3) allowing sufficient time for diffusion of the solvent into the polymer and of the polymer into the solvent to occur to thereby form a solution) by controlling the harshness of the environment in which the polymer is processed. For example, polymer residence time in the extruder should be minimized as described in U.S. Pat. No. 8,444,898 to minimize polymer degradation resulting from the intense heat and the amount of shear on the polymer, which are deleterious to the polymer molecular weight. Accordingly, it is desired to initiate formation of the polymer-solvent liquid mixture by heating it outside the extruder (e.g., in a slurry tank), thereby allowing some melt formation in a gentler environment. This in turn will reduce the polymer residence time in the extruder, thereby reducing the polymer thermal and shear degradation.

In addition to increasing the residence time of the polymer in the slurry tank, preferably in a heated slurry tank, reducing the extruder temperature will help create the solution in a gentler environment. For example, the temperature at which a liquid mixture of molten UHMW PE polymer and the spinning solvent is formed in the extruder is typically from about 140° C. to about 320° C. Temperatures at the bottom of this range should be used to minimize polymer degradation. As is also known from commonly-owned U.S. Pat. No. 8,444,898, the residence time of the mixture in the extruder may also be limited by promptly passing the polymer-solvent mixture from the extruder and into a heated vessel (e.g., a heated pipe, with or without static mixers), where the remaining time needed for the solvent and polymer to completely diffuse into each other and form a uniform, homogenous solution is provided. In this regard, operating conditions that can facilitate the formation of a homogeneous solution include, for example: (1) raising the temperature of the liquid mixture of the UHMW PE and the spinning solvent to a temperature near or above the melting temperature of the UHMW PE, and (2) maintaining the liquid mixture at said raised temperature for a sufficient amount of time to allow the spinning solvent to diffuse into the UHMW PE and for the UHMW PE to diffuse into the spinning solvent. Preferably, most of the time needed to convert the polymer-solvent slurry into a liquid mixture and then into a homogenous solution will be spent in the heated vessel, and preferably the average residence time of the polymer-solvent mixture in the extruder is less or equal to about 1.5 minutes, more preferably less than or equal to about 1.2 minutes, and most preferably less than or equal to about 1.0 minutes. The heated vessel, like the extruder, is typically maintained at a temperature of from about 140° C. to about 320° C., but without active mixing. The residence time of the liquid mixture in the heated vessel can be from about 2 minutes to about 120 minutes, preferably from about 6 minutes to about 60 minutes, to form a solution. Variations of this procedure may also be appropriate employed. For example, the placement and utilization of the heated vessel and the extruder can be reversed wherein a liquid mixture of UHMW PE and spinning solvent is first formed in a heated vessel and then passed through an extruder to form the solution.

Further opportunities for intrinsic viscosity retention exist in post-solution processing. For example, upon exiting the spinneret, the polymer solution is passed through a gaseous space and into a liquid quench bath (e.g., water, ethylene glycol, ethanol, isopropanol, preferably maintained at from about −35° C. to about 35° C.) to form gel filaments. The solution filaments are vulnerable to oxidation as they pass through this space if the space contains oxygen, such as if the space is filled with air, so to minimize polymer degradation and maximize fiber $IV_f$, it may be desired to fill the gaseous space with nitrogen or another inert gas like argon to prevent any oxidization. Limitation of the length gaseous space will also minimize the potential for oxidation, particularly if filling the gap with an inert gas is impractical. The length of the gaseous space between the spinneret and the surface of the liquid quench bath is preferably from about 0.3 cm to about 10 cm, more preferably from about 0.4 cm to about 5 cm. If the residence time of the solution filaments in the gaseous space is less than about 1 second, the gaseous space may be filled with air, otherwise filling the space with an inert gas is most preferred. High $IV_0$ and $IV_f$ may also be achieved by improving the quality of the polymer raw material. For example, it is known that the particle size and particle size distribution of the particulate UHMW PE polymer can affect the extent to which the UHMW PE polymer dissolves in the spinning solvent during formation of the solution that is to be gel spun, which can affect the ultimate tensile strength potential of the fiber. It is desirable that the UHMW PE polymer be completely dissolved in the solution and accordingly, it is preferred that the fibers are spun from a UHMW PE polymer having an average particle size of from about 100 am to about 400 am, most preferably from about 100 am to about 200 am, said particles also preferably having a weight average molecular weight of from about 300,000 to about 7,000,000, more preferably from about 700,000 to about 5,000,000, as described in U.S. Pat. No. 9,169,581. Preferably, an UHMW PE of the disclosure has a ratio of weight average molecular weight to number average molecular weight ($M_w/M_n$) of 4 or less, more preferably an $M_w/M_n$ ratio of 3 or less, still more preferably an $M_w/M_n$ ratio of 2 or less, and even more preferably an $M_w/M_n$ ratio of about 1.

The UHMW PE itself may contain small amounts, generally less than about 5 wt. %, preferably less than about 3 wt. % of additives such as antioxidants, thermal stabilizers, colorants, flow promoters, solvents, etc. U.S. Pat. Nos. 8,747,715; 8,889,049; 9,365,953 and 9,556,537 additionally recognize the significance of a property known as the Cogswell extensional viscosity (λ) of the UHMW PE polymer raw material and its influence on fiber processability and fiber tensile properties, teaching that a 10 wt. % solution of the UHMW PE polymer in mineral oil at 250° C. should have a Cogswell extensional viscosity (λ) in accordance with the formula, $\lambda \geq 5{,}917(IV)^{0.8}$, wherein IV refers to the $IV_0$.

Preferred spinning solvents that may be used in forming solution/gel spun fibers from said UHMW PE polymers include hydrocarbons having a boiling point over 100° C. at atmospheric pressure, and preferred spinning solvents can be selected from the group consisting of hydrocarbons such as aliphatics, cyclo-aliphatics, and aromatics; and halogenated hydrocarbons such as dichlorobenzene and mixtures thereof. In some examples, the spinning solvent can have a boiling point of at least about 180° C. at atmospheric pressure. In such examples, the spinning solvent can be selected from the group consisting of halogenated hydrocarbons, mineral oil, decalin, tetralin, naphthalene, xylene, toluene, dodecane, undecane, decane, nonane, octene, cis-decahydronaphthalene, trans-decahydronaphthalene, low molecular weight polyethylene wax, and mixtures thereof. Preferably, the solvent is selected from the group consisting of cis-decahydronaphthalene, trans-decahydronaphthalene, decalin, mineral oil and their mixtures. The most preferred spinning solvent is mineral oil, such as HYDROBRITE® 550 PO white mineral oil, commercially available from Sonneborn, LLC of Mahwah, N.J. The HYDROBRITE® 550 PO mineral oil consists of from about 67.5% paraffinic carbon to about 72.0% paraffinic carbon and from about 28.0% to about 32.5% napthenic carbon as calculated according to ASTM D3238. Each of the slurry, liquid mixture and solution formed according to the preferred gel/solution spinning methods will include UHMW PE in an amount of from about 1% by weight to about 50% by weight of the solution, preferably from about 1% by weight to about 30% by weight of the solution, more preferably from about 2% by weight to about 20% by weight of the solution, and even more preferably from about 3% by weight to about 10% by weight of the solution.

U.S. Pat. Nos. 8,444,898 and 8,506,864 teach additional steps that may be taken to minimize intrinsic viscosity degradation during the fiber spinning process, particularly teaching that degradation of the polymer may be minimized by first forming the UHMW PE powder and solvent into a slurry in an extruder followed by processing that slurry through the extruder at a throughput rate of at least the quantity 2.0 $D^2$ grams per minute (g/min; wherein D represents the screw diameter of the extruder in centimeters) to thereby form a liquid mixture. That liquid mixture is then converted into a solution in a heated vessel, not in the extruder, whereby the heated vessel exerts very little, if any, shear stress on the mixture.

Accordingly, consistent with the objectives of this disclosure, at least one or all of the fibers forming the elongate bodies of the disclosure should be fabricated from a UHMW polyethylene polymer having an intrinsic viscosity in decalin at 135° C. of at least about 21 dl/g, or greater than about 21 dl/g, more preferably from about 21 dl/g to about 100 dl/g, still more preferably from about 30 dl/g to about 100 dl/g, still more preferably from about 35 dl/g to about 100 dl/g, still more preferably from about 40 dl/g to about 100 dl/g, still more preferably from about 45 dl/g to about 100 dl/g, and still more preferably from about 50 dl/g to about 100 dl/g, with all intrinsic viscosity values identified herein throughout being measured in decalin at 135° C. An initial high $IV_0$ of at least about 21 dl/g will permit some degree of IV degradation while also ensuring the fabrication of fibers having a high $IV_f$ of 15 dl/g or more, typically having an $IV_f$ of from 15 dl/g to about 45 dl/g, or from 30 dl/g to about 45 dl/g, or from 35 dl/g to about 45 dl/g or from 40 dl/g to about 45 dl/g.

In addition to describing effective methods for fabricating UHMW PE fibers having an $IV_f$ of 15 dl/g or more, many of the above-incorporated U.S. patents also teach methods of drawing fibers during the spinning process. U.S. Pat. Nos. 8,444,898, 8,506,864; 8,747,715; 8,889,049; 9,365,953 and 9,556,537, in particularly teach methods of drawing fibers during the spinning process, as well as post-spinning drawing operations that further increase fiber tenacity. Each of these methods of drawing fibers is effective in enhancing fiber tenacity, but as the fibers are drawn the denier and denier per filament (i.e., the denier of each individual filament forming the multifilament fiber (i.e., forming the fiber/bundle)) decrease and the fibers become more susceptible to fracture. Therefore, while the spinning and drawing methods described in said patents may be usefully employed to fabricate the one or more UHMW PE fibers of this disclosure, it is necessary that the extent of drawing be limited to ensure a filament denier of greater than 2.0 and an overall fiber denier of greater than 800, preferably at least 1000, and most preferably 1600 or more, while also achieving a high fiber tenacity of at least 32 g/d.

This is achievable when the intrinsic viscosity (a measure of the polymer molecular weight) of the polymer is above 15 dl/g as a raw material and is maintained above 15 dl/g during and after the fiber spinning process, together with limiting the extent of the post-draw operation for such high molecular weight fibers (although drawing of the solution fiber and gel fiber may likewise be limited). For example, U.S. Pat. No. 9,365,953 teaches a UHMW PE fiber having a tenacity of at least about 45 g/denier that is produced by a process comprising the steps of: a) feeding a slurry that comprises an UHMW PE polymer (supplied as a powder) and a spinning solvent to an extruder to produce a liquid mixture, the UHMW PE polymer having an intrinsic viscosity in decalin at 135° C. of at least about 30 dl/g; or feeding the UHMW PE polymer and spinning solvent into an extruder and forming both a slurry and a liquid mixture inside the extruder; b) passing the liquid mixture through a heated vessel to form a homogeneous solution comprising the UHMW PE polymer and the spinning solvent; c) providing the solution from the heated vessel to a spinneret to form a solution fiber; d) drawing the solution fiber that issues from the spinneret at a draw ratio of from about 1.1:1 to about 30:1 to form a drawn solution fiber; e) cooling the drawn solution fiber to a temperature below the gel point of the UHMW PE polymer to form a gel fiber; f) drawing the gel fiber in one or more stages at a first draw ratio DR1 of from about 1.1:1 to about 30:1; g) drawing the gel fiber at a second draw ratio DR2; h) removing spinning solvent from the gel fiber in a solvent removal device to form a dry fiber; i) drawing the dry fiber at a third draw ratio DR3 in at least one stage to form a partially oriented fiber; j) transferring the partially oriented fiber to a post-drawing operation; and k) drawing the partially oriented fiber at a post-drawing temperature in the post-drawing operation to a fourth draw ratio DR4 of from about 1.8:1 to about 15:1 to form a highly oriented fiber product having a tenacity of at least about 45 g/denier.

Accordingly, said fibers of U.S. Pat. No. 9,365,953 are subjected to multiple drawing steps, wherein the term "draw ratio" refers to the ratio of the speeds of the draw rolls used during the orientation process. First, the solution fiber that issues from the spinneret is drawn at a draw ratio of from about 1.1:1 to about 30:1. Next, the solidified gel fiber is drawn at two draw ratios wherein DR1 is from about 1.1:1 to about 30:1 and DR2 is from about 1.5:1 to about 3.5:1. The dried fiber is then drawn at a draw ratio (DR3) of from about 1.10:1 to about 3.00:1, and then the dry fiber is subjected to an off-line, post-drawing operation wherein it is drawn at a draw ratio (DR4) of from about 1.8:1 to about 15:1 to increase the tenacity of the fiber to 45 g/denier. Each of these drawing steps incrementally increases the fiber tenacity while decreasing the fiber denier, and therefore the drawing profile can be customized to limit the tenacity increase and denier reduction as well. For example, U.S. Pat. No. 9,365,953 provides that the combined draw of the gel fiber and the dry fiber, which can be determined by multiplying DR1, DR2 and DR3 (written as DR1×DR2×DR3:1 or (DR1)(DR2)(DR3):1) should be at least about 5:1, more preferably at least about 10:1, and most preferably at least 12:1. In an embodiment where similar drawing steps as per U.S. Pat. No. 9,365,953 are followed but drawing of the solution fiber and gel fiber are limited, the value of DR1×DR2×DR3:1 (or (DR1)(DR2)(DR3):1) may be from 1.1:1 up to less than 5:1, or from 1.1:1 up to 4:1, or from 1.1:1 up to 3:1 or from 2:1 up to 4:1.

In a preferred embodiment of the present disclosure, UHMW PE fibers useful herein are produced according to the method of U.S. Pat. No. 9,365,953, but wherein post-drawing of the fiber(s) is limited to maintain a filament denier of greater than 2.0, an overall fiber denier of greater than 800, preferably at least 1000, and preferably 1600 or more, and a fiber tenacity of at least 32 g/d, preferably from 35 g/d up to 45 g/d. This may be accomplished, for example, by conducting a post-drawing operation in accordance with the process disclosed in U.S. Pat. No. 9,365,953 but wherein the post-drawing draw ratio (DR4) is from about 1.1:1 to about 4.5:1, or from about 2.0:1 to about 3.5:1, or from about 2.5:1 to about 2.7:1. Alternatively, post-drawing may be conducted at a draw ratio of from about 1.1:1 to 1.7:1, or from about 1.1:1 to 1.6:1, or from 1.1:1 to 1.5:1, or from about 1.1:1 to about 1.4:1, or from 1.1:1 to 1.3:1, or from 1.1:1 to 1.2:1. Any of these post-drawing draw ratio ranges may also be performed in conjunction with limiting overall drawing so that DR1, DR2 and DR3 as defined in U.S. Pat. No. 9,365,953 are limited to have a DR1×DR2×DR3:1 ratio (or (DR1)(DR2)(DR3):1 ratio) of from 1.1:1 up to less than 5:1, or from 1.1:1 up to 4:1, or from 1.1:1 up to 3:1 or from 2:1 up to 4:1, and after all fiber drawing/stretching is completed such fibers (multifilament fibers) will have a denier per filament (dpf) ranging from about 2.0 dpf to about 7.0 dpf, more preferably from about 2.3 dpf to about 6.0 dpf, more preferably from about 2.5 dpf to about 5.0 dpf, and most preferably from about 3.0 dpf to about 5.0 dpf, and a filament intrinsic viscosity ($IV_f$) of from 15 dl/g to about 45 dl/g when measured in decalin at 135° C., and a tenacity of at least 32 g/denier; and in accordance with the preferred embodiments of this disclosure, the elongate bodies/ropes of this disclosure will comprise at least one multifilament polyolefin fiber possessing all of said properties that also has a denier of greater than 800, i.e., said at least one multifilament polyolefin fiber is fabricated to include at least enough component filaments to have a denier of greater than 800 when adding up the sum of the deniers of all the component filaments that form the fiber. Fibers formed from filaments having deniers within these ranges, as well as said other properties of intrinsic viscosity and tenacity, will have been stretched to an extent that is significantly less than their maximum drawing capacity, wherein they have an elongation-to-break of about 4.0% or less, and typically from about 3.0% to 4.0% as determined according to the testing method of ASTM D638.

Figure 2:
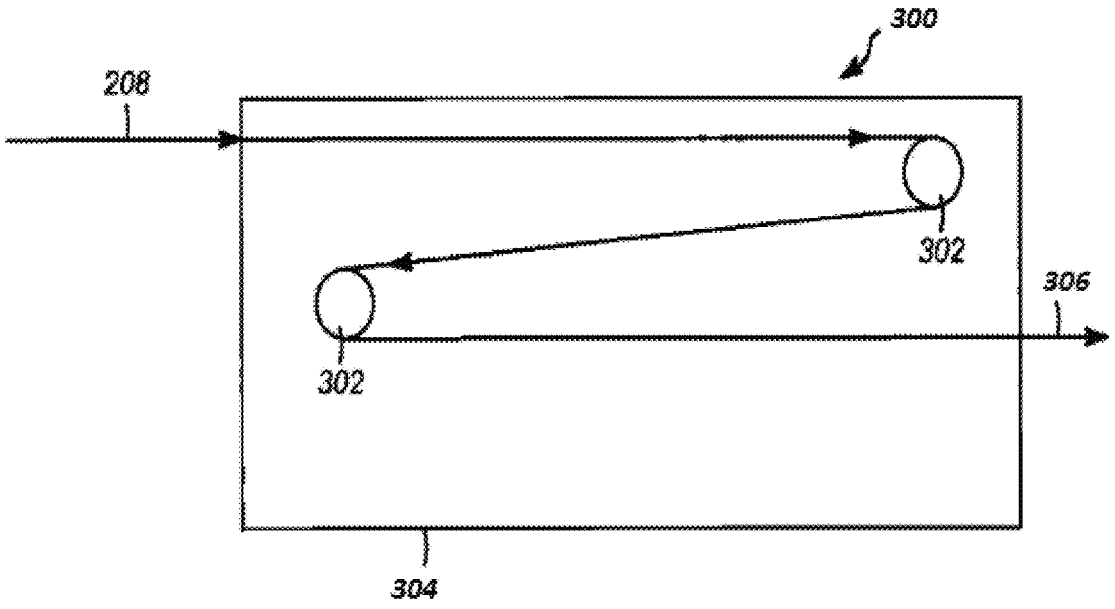
FIG. 2 illustrates an exemplary post-drawing process wherein a fiber is drawn by being passed in multiple directions through a single oven.
Figure 3:
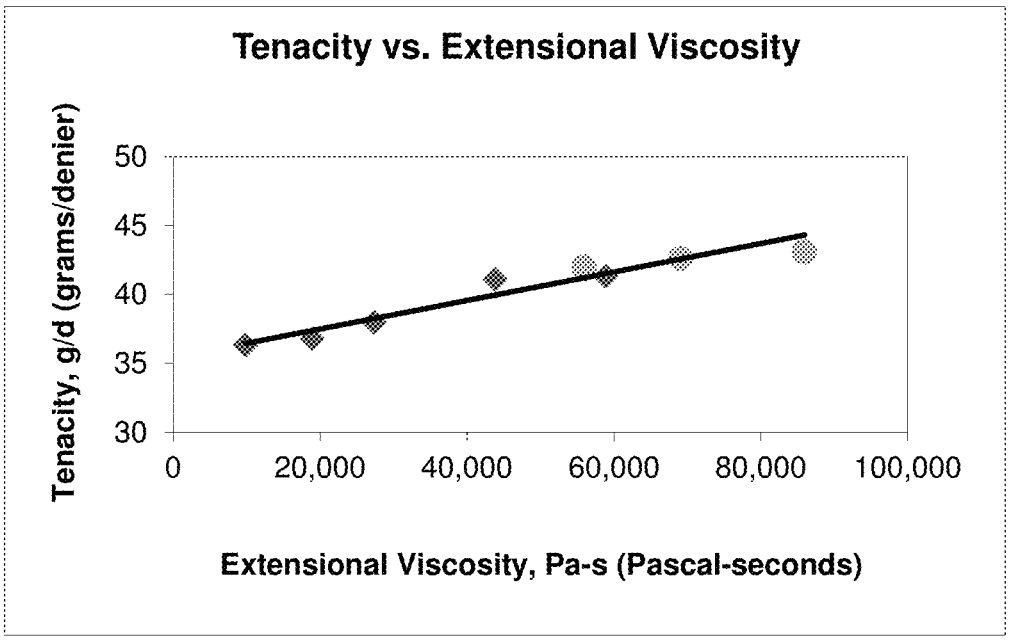
FIG. 3 is a graph plotting fiber tenacity versus the Cogswell extensional viscosity of a 10 wt. % solution of a UHMW PE polymer in mineral oil at 250° C. for a fiber spun from a solution of that polymer.

In this regard, methods of drawing fibers are conventionally known in the art and any suitable method may be employed, including the methods of U.S. Pat. Nos. 6,969,553; 7,370,395; 7,344,668, 8,747,715; 9,365,953 and 9,556,537, each of which is incorporated by reference herein to the extent consistent herewith. Generally, post-drawing of the dry fiber is accomplished in at least one stage by passing a continuous fiber through a heated environment provided by a heating apparatus, such as a forced air convection oven, at a post-drawing temperature of from about 125° C. to about 160° C. Drawing may be conducted in a single pass through the oven or multiple passes, with drawing being initiated once the fiber reaches the desired temperature within said range. Exemplary post-drawing apparatuses are illustrated in FIGS. 1 and 2. As illustrated in FIG. 1, a post-drawing process 200 is conducted by passing a continuous fiber 208 through a heating apparatus 202 having a first set of rolls 204 that are external to the heating apparatus 202 and a second set of rolls 206 that are external to the heating apparatus 202. The fiber 208 can be fed from a source and passed over the first set of rolls 204. The first set of rolls 204 can be driven rolls, which are operated to rotate at a desired speed to provide the fiber to the heating apparatus 202 at a desired feed velocity of $V_1$ meters/minute. The first set of rolls 204 can include a plurality of individual rolls 210. In one example, the first few individual rolls 210 are not heated, and the remaining individual rolls 210 are heated in order to preheat the fiber 208 before it enters the heating apparatus 202. Although the first set of rolls 204 includes a total of seven (7) individual rolls 210 as shown in FIG. 1, the number of individual rolls 210 can be higher or lower, depending upon the desired configuration.

As illustrated in said figure, the fiber 208 can be fed into the heating apparatus 202, which includes one or more ovens. The one or more ovens as illustrated can be adjacent horizontal ovens. Each oven is preferably a forced convection air oven. It is desirable to have effective heat transmission between the fiber 208 and the air in the ovens, so the air circulation within each oven is preferably in a turbulent state, and the time-averaged air velocity within each oven in the vicinity of the fiber 208 is preferably from about 1 meter/minute to about 200 meters/minute. In the illustrated example, six adjacent horizontal ovens 212, 214, 216, 218, 220, and 222 are shown, although any suitable number of ovens can be utilized. The heating apparatus can be of any suitable fiber path length and each of the ovens can each have any suitable length to provide the desired fiber path length. For example, each oven may be from about 10 feet to about 16 feet (3.05 meters to 4.88 meters) long. The temperature and speed of the fiber 208 through the heating apparatus 202 can be varied as desired. The path of the fiber 208 in heating apparatus 202 can be an approximate straight line and the tension profile of the fiber 208 during the post-drawing process can be adjusted by adjusting the speed of the various rolls or by adjusting the temperature profile of the heating apparatus 202. Preferably, the tension of the fiber 208 in the heating apparatus 202 is approximately constant, or is increasing through the heating apparatus 202. A heated fiber 224 exits the last oven 222 and can then be passed over the second set of rolls 206 to form the final fiber product 226. The second set of rolls 206 can be driven rolls which are operated to rotate at a desired speed to remove the heated fiber 222 from the heating apparatus 202 at a desired exit velocity of $V_2$ meters/minute. The second set of rolls 206 can include a plurality of individual rolls 228. Although the second set of rolls 206 includes a total of seven (7) individual rolls 228 as shown in FIG. 1, the number of individual rolls 228 can be higher or lower depending upon the desired configuration. Additionally, the number of individual rolls 228 in the second set of rolls 206 can be the same or different from the number of individual rolls 210 in the first set of rolls 204. Preferably, the second set of rolls 206 can be cold, so that the final fiber product 226 is cooled to a temperature below at least about 90° C. under tension to preserve its orientation and morphology.

An alternative heating apparatus 300 is illustrated in FIG. 2. As illustrated, the heating apparatus 300 can include one or more ovens, such as a single oven 304. Each oven is preferably a forced convection air oven having the same conditions as the ovens of FIG. 1. The oven 304 can have any suitable length, and in one example can be from about 10 feet to about 20 feet (3.05 to 6.10 meters) long. The oven 304 can include one or more intermediate rolls 302, over which the fiber 208 can be passed in the oven 304 to change its direction in order to increase the path of travel of the fiber 208 within the heating apparatus 300. Each of the one or more intermediate rolls 302 can be a fixed roll that does not rotate, a driven roll that rotates at a predetermined speed, or an idler roll that can rotate freely, as the fiber 208 passes over it. Additionally, each of the one or more intermediate rolls 302 can be located internal to the oven 304, as shown, or alternatively one or more intermediate rolls 302 can be located external to the oven 304. Utilization of the one or more intermediate rolls 302 increases the effective length of the heating apparatus 300. Any suitable number of intermediate rolls can be utilized in order to provide the desired total yarn path length. A final fiber product 306 then exits the oven, or alternatively the fiber product 306 may be further drawn with additional exterior rolls similar to those illustrated in FIG. 1. In either embodiment, the varying velocity of the first set of rolls (e.g., the velocity of feed rolls, $V_1$ (meters/minute)) and the second set of rolls (e.g., the velocity of exit rolls, $V_2$ (meters/minute)) will determine the draw ratio at each stage of a drawing process (e.g., solution fiber drawing, DR1, DR2, DR3 and DR4), and such drawing will reduce the denier of each filament of the fiber being stretched.

By fabricating the fibers from a high $IV_0$ UHMW PE polymer and taking steps to maintain that polymer intrinsic viscosity during the spinning process as discussed above, such as nitrogen sparging the solvent, the solvent-UHMWPE polymer mixture and/or the solvent-UHMWPE polymer solution, drawing of the fiber according to any of the conditions stated above may be limited to maintain the denier of the filaments to at least 2.0 while also reaching a fiber tenacity of from 32 g/denier to 45 g/d. Such fibers will have a preferred post-stretching denier per filament (dpf) ranging from about 2.0 dpf to about 7.0 dpf, more preferably from about 2.3 dpf to about 6.0 dpf, more preferably from about 2.5 dpf to about 5.0 dpf, and most preferably from about 3.0 dpf to about 5.0 dpf. Fibers formed from filaments having deniers within these ranges will have been maximally stretched to have an elongation-to-break of about 4.0% or less, typically from about 3.0% to 4.0% according to testing method of ASTM D638.

Once suitable fibers are fabricated they may be formed into ropes or other multi-fiber structures according to conventional methods in the art, wherein a plurality of fibers are combined, for example, by twisting, braiding, entangling, or a combination thereof these techniques, or other conventional known techniques for joining together a plurality of fibers. In this regard, ropes of this disclosure may be of any suitable construction, such as braided ropes, twisted ropes, wire-lay ropes, parallel core ropes, and the like. In one embodiment of this disclosure, the elongate bodies consist or consist essentially of braided, twisted or entangled polyolefin fibers, or more preferably, braided, twisted or entangled polyethylene fibers. In another embodiment, the elongate bodies may be formed wherein they further incorporate one or more core fibers, wherein a braided body surrounds the core fiber(s) as a sheath.

Core-sheath braided constructions are conventionally known in both rope applications. Suitable core fibers non-exclusively include any stretchable synthetic fiber, regenerated fiber or metal fiber, and may optionally also include ceramic or glass fibers. Particularly suitable core fibers are stretchable thermoplastic fibers, including polyolefin fibers, polyester fibers and fluororesin fibers. When forming a core-sheath rope construction herein, a braided body may be formed around the core with the core as a central axis using conventional equipment, such as braiding machines available from Herzog Maschinenfabrik GmbH of Oldenberg, Germany, and using any conventionally known method, such as plaiting or other braid constructions, as well as a double braid technique where the core "fiber" itself is a braided structure. In this embodiment, the braided sheath structure preferably incorporates from 2 to 100 discrete fibers for small diameter ropes, or thousands of discrete fibers for large diameter ropes, such as from 5000-6000 discrete fibers or more.

In a core-sheath construction, the braided fibers and the core are optionally fused together. Fusion of the braided fibers with the core is typically accomplished with the application of heat and tension, optionally with the application of a solvent or plasticizing material prior to exposure to heat and tension as described in U.S. Pat. Nos. 5,540,990; 5,749,214; and 6,148,597, the disclosures of which are hereby incorporated by reference to the extent consistent herewith. As described in these patents, the braided body is subjected to stretching at an elevated temperature that is within the melting point range of the filament polymer material and for a time that is sufficient to soften the filaments and to at least partially fuse together the contact surfaces of the individual filaments forming the fiber into a line having monofilament-like characteristics.

Fusion may also be accomplished by bonding, for example, by at least partially coating the fibers of the sheath and/or core with a thermoplastic resin or other polymeric binder material having adhesive properties. Suitable thermoplastic resins non-exclusively include polyolefin resins such as polyolefin wax, low density polyethylene, linear low density polyethylene, polyolefin copolymers, ethylene copolymers such as ethylene-acrylic acid copolymer, ethylene-ethyl acrylate copolymer, ethylene-vinyl acetate copolymer, polyisoprene-polystyrene-block copolymers (such as KRATON® D1107 commercially available from Kraton Polymers of Houston, Tex.), polyurethanes, polyvinylidene fluoride, polychlorotetrafluoroethylene (PCTFE), and copolymers and blends of one or more of the foregoing. Suitable polyolefin waxes non-exclusively include ACumist® micronized polyolefin waxes commercially available from Honeywell International Inc. of Morristown, N.J. The most preferred thermoplastic resin will have a lower melting point than the specific polyolefin fiber that is utilized and is a drawable material, and most preferably is a polyolefin resin. The fibers of the braided body sheath may also be thermally bonded together and/or to the core fiber without an adhesive coating. Thermal bonding conditions will depend on the fiber types. The fibers may also be pre-coated with an oil prior to fusing, such as mineral oil, paraffin oil or vegetable oil as is conventionally known in the art, such as is described in U.S. Pat. Nos. 5,540,990; 5,749,214; and 6,148,597. As stated in said patents, mineral oil acts as a plasticizer that enhances the efficiency of the fusion process permitting the fusion process to be performed at lower temperatures. Any conventional method may be used to coat the fibers with the oil or thermoplastic resin, such as dipping, spraying or otherwise passing the fibers through bath of the coating material.

When the fibers of the sheath and/or the core are coated with a resin or other polymeric binder material having adhesive properties to bond the fibers together, only a small amount of the resin/binder is needed. In this regard, the quantity of resin/binder applied is typically no more than 5% by weight based on the total weight of the fibers plus the resin/binder, such that the fibers comprise at least 95% by weight of the coated fibers based on the total weight of the fibers plus the resin/binder. Accordingly, the elongate body will comprise at least 95% by weight of the component fibers. In more preferred embodiments, the elongate bodies comprise at least about 96% fiber by weight, still more preferably 97% fiber by weight, still more preferably 98% fiber by weight, and still more preferably 99% fiber by weight. Most preferably, the elongate bodies are completely resin-free, i.e. are not coated with any bonding resin/binder and consist essentially of or consist of fibers/filaments.

In the most preferred embodiments herein, the elongate bodies consist or consist essentially of the braided body without incorporating a core fiber, such that the braided body is essentially a braided rope of any diameter that includes no unbraided fibers or strands. The braided bodies are preferably round, having a round, circular or oval cross section, rather than flat and may be formed using any conventionally known braiding technique as would be determined by one skilled in the art, such as plaiting, single braid, solid braid or hollow braid techniques. These braided bodies where no core fiber is present are made with conventional braiding equipment and methods. Suitable braiding equipment is commercially available, for example, from Herzog Maschinenfabrik GmbH of Oldenberg, Germany. For example, in forming a braided rope a conventional braiding machine may be employed which has a plurality of bobbins. As is known in the art, as the bobbins move about, the fibers are threaded over and under each other and are eventually collected on a take-up reel. Details of braiding machines and the formation of ropes therefrom are known in the art and are therefore not disclosed in detail herein.

Preferably, braided bodied formed from a plurality of fibers, wherein at least one of said fibers comprises a multifilament ultra-high molecular weight polyolefin fiber having a filament intrinsic viscosity ($IV_f$) of from 15 dl/g to about 45 dl/g when measured in decalin at 135° C., wherein said at least one multifilament ultra-high molecular weight polyolefin fiber has a tenacity of at least 32 g/denier, a denier of greater than 800, and a denier per filament of greater than 2.0, will incorporate from 2 to about 100 discrete fibers, more preferably from 3 to 40, still more preferably from 3 to 20 discrete fibers and still more preferably from 3 to 15 discrete fibers. However, as noted above, more than 100 discrete fibers may be incorporated depending on the desired diameter of the ropes, potentially including thousands of discrete fibers, such as about 5000-6000 discrete fibers or more depending on the denier per fiber and the desired end use. The diameter of a fiber can be calculated from the fiber denier with the following formula:

$$\text{Diameter} = \sqrt{\frac{\text{Denier}}{9000 \cdot \text{density} \cdot 0.7855}}$$

wherein density is in grams per cubic centimeter ($g/cm^3$)(g/cc) and the diameter is in mm. Ultra-high molecular weight polyethylene has a density of 0.97 g/cc, though at very high molecular weights that may increase to from about 0.98 g/cc to about 0.995 g/cc, as would be known by one skilled in the art. Generally, a lower fiber denier corresponds to a lower fiber diameter. In the preferred embodiments herein, at least one multifilament fiber forming the elongate body (e.g., a braided rope) has a denier of from about 800 to about 5000, more preferably from about 800 to 4000 denier, still more preferably from about 800 to about 3000 denier, still more preferably from about 800 to about 1600 denier, still more preferably about 900 or greater, still more preferably from 900 to about 3000, still more preferably from about 900 to about 1600, still more preferably about 1000 or greater, still more preferably from about 1000 to about 1600.

The overall denier of the elongate body/rope will depend on the number of said multi-filament fibers that are combined to form the elongate body/rope, which will generally depend on the requirements of the rope end use application. An elongate body itself incorporating at least two discrete fibers, for example, a braided body having from 3 to 12 discrete fibers without a core fiber, will have a preferred denier of 1500 or greater, more preferably greater than 2300, still more preferably from greater than 2300 to about 5000, more preferably greater than 2500, still more preferably from greater than 2500 to about 5000, more preferably greater than 3000, still more preferably from greater than 3000 to about 5000. The braid denier will typically be greater than the combined denier of all the component fibers because due to the braid construction, where fibers are turned over each other at the crossover points, i.e. picks, 9000 meters of the braid will incorporate more than 9000 meters of each individual fiber. In this regard, preferred ropes will have a denier of at least 1500, preferably from 1500 to about 30,000, more preferably about 1600 or more, more preferably from about 1600 to about 26,000, and still more preferably from about 8,000 to about 26,000. A most preferred rope will have from about 3 to about 50 individual fibers, preferably from about 10 to about 20 individual fibers, preferably wherein each individual fiber has a denier of greater than 800, preferably about 900 or greater, still more preferably about 1000 or greater, still more preferably about 1100 or greater, still more preferably about 1200 or greater, still more preferably about 1300 or greater, still more preferably about 1400 or greater, still more preferably about 1500 or greater, still more preferably about 1600 or greater, still more preferably about 1700 or greater, still more preferably about 1800 or greater, still more preferably about 1900 or greater and still more preferably each individual fiber has a denier of about 2000 or greater, with the rope (e.g., braided body) incorporating at least 3 to about 20 of the individual fibers, more preferably from about 3 to about 15, and most preferably from about 5 to about 13 individual fibers. The size of the rope is dependent on the required breaking strength and/or other properties as determined by the desired end use.

It is also particularly within the scope of this disclosure that any ranges presented with minimum and maximum terminal values is intended to support any ranges within said terminal values that are not expressly stated herein.

Fibers forming single braided, solid braided or hollow bodies may optionally be fused together according to the techniques described above from U.S. Pat. Nos. 5,540,990; 5,749,214; and 6,148,597, wherein the individual fibers forming the braided body are fused together optionally with the application of heat and tension. When this option is performed, the braided body is optionally subjected to stretching, optionally at an elevated temperature that is within the melting point range of the filament polymer material that is sufficient to at least partially fuse the contact surfaces of the individual filaments forming the fiber into a line having monofilament-like characteristics. Conditions useful for the stretching/surface fusion process are the same as recited above for core-sheath fibers. As noted above regarding the core/sheath structures, the fibers forming non-core/sheath braided bodies may also be at least partially coated with either a thermoplastic resin or an oil followed by fusing them together as noted above, and such coating may be applied either before or after twisting, entangling or braiding the fibers to form the braided/twisted/entangled structure. Suitable thermoplastic resins, waxes and oils are the same as those described above. However, in the most preferred embodiments, the fibers forming the braided body are not fused together, i.e. they are unfused. This is distinguished from the method of U.S. Pat. Nos. 5,540,990; 5,749,214; and 6,148,597 where the fibers are fused together.

After the braided body is formed, it may be stretched or non-stretched. Stretching may be performed with or without heating the fibers/braided body, although heating is preferred. As described herein, stretching of the braided body refers to stretching after braiding the fibers together into the braided body, wherein even in a non-stretched braided body, the component fibers forming the braided body are already stretched prior to braiding during the gel/solution spinning process as described above. When it is desired to stretch the braided body with heat but without fusing the component fibers of the braid, fusing is avoided by heating the braided body to a temperature below the melting point of the fibers. For example, when the braided body incorporates ultra-high molecular weight, gel spun polyethylene multifilament fibers, this temperature is preferably within the range of from about 145° C. to about 153° C., more preferably from about 148° C. to about 151° C. In this regard, it is noted that highly oriented, ultra-high molecular weight polyethylene fibers generally have a higher melting point than bulk UHMW PE or lower molecular weight polyethylenes. During this stretching without fusion process, the fiber is preferably held under tension that is preferably applied continuously. Preferably, the stretching step without fusion is conducted at an overall stretching ratio in one or more stages of stretching of from about 1.01 to about 3.0, and more preferably from about 1.1 to about 1.8, preferably with the application of heat.

The braided bodies of this disclosure may have any desired braid density, also referred to in the art as braid tightness. The angle which the braid component makes relative to the braid axis is called the braid angle. The braid density may be adjusted as desired using the selected equipment to increase or decrease the braid angle along the length of the braid. In the preferred embodiments, the braided body has a braid angle of less than about 40° or from about 5° to about 40°, more preferably the braid angle is 30° or less or from about 5° to about 30°, and most preferably from about 15° to about 30°. Each of these ranges is specific to the braid density/tightness of non-stretched braided bodies, i.e., the braided bodies after braiding but before any optional additional stretching of the braided bodies.

The multifilament fibers may optionally be twisted or air entangled prior to braiding. Various methods of twisting fibers are known in the art and any method may be utilized. Useful twisting methods are described, for example, in U.S. Pat. Nos. 2,961,010; 3,434,275; 4,123,893; 4,819,458 and 7,127,879, the disclosures of which are incorporated herein by reference to the extent consistent herewith. In a preferred embodiment, the fibers are twisted to have an angle relative to the twisted bundle axis of 5° up to about 40°, more preferably from about 5° to about 30° and most preferably from about 15° up to about 30°. The standard method for determining twist in twisted fibers is ASTM D1423. Similarly, various methods of air entangling multifilament fibers are conventionally known and described, for example, in U.S. Pat. Nos. 3,983,609; 4,125,922; and 4,188,692, the disclosures of which are incorporated by reference herein to the extent consistent herewith. In a preferred embodiment, the multifilament fibers are neither twisted nor air entangled. Also, prior to braiding multiple fibers together to form the braided body, the individual fibers themselves are preferably non-braided.

While the braided bodies of the most preferred embodiments are said to include only multifilament polyethylene fibers having tenacities of at least 32 g/denier, they may additionally include other polyolefin or polyethylene fibers having different tenacities, including any fibers disclosed, for example, in U.S. Pat. Nos. 4,411,854; 4,413,110; 4,422,993; 4,430,383; 4,436,689; 4,455,273; 4,536,536; 4,545,950; 4,551,296; 4,584,347; 4,663,101; 5,248,471; 5,578,374; 5,736,244; 5,741,451; 5,972,498; 6,448,359, 6,969,553; 7,078,097; 7,078,099; 7,081,297; 7,115,318; 7,344,668; 7,638,191; 7,674,409; 7,736,561; 7,846,363; 8,070,998; 8,361,366; 8,444,898; 8,506,864; and 8,747,715, each of which is incorporated herein by reference to the extent consistent herewith. This includes all polyolefin fiber types, including polypropylene fibers, high density polyethylene and low density polyethylene fibers. The braided bodies may also include as component fibers other non-polyolefin fibers, such as conventionally known and commercially available aramid fibers, particularly para-aramid fibers and meta-aramid fibers, polyamide fibers, polyester fibers including polyethylene terephthalate fibers and polyethylene naphthalate fibers, extended chain polyvinyl alcohol fibers, extended chain polyacrylonitrile fibers, polybenzazole fibers, such as polybenzoxazole (PBO) and polybenzothiazole (PBT) fibers, polytetrafluoroethylene fibers, carbon fibers, graphite fibers, silicon carbide fibers, boron carbide fibers, glass fibers, regenerated fibers, metal fibers, ceramic fibers, graphite fibers, liquid crystal copolyester fibers and other rigid rod fibers such as M5® fibers, as well as fibers formed from copolymers, block polymers and blends of the above materials. However, not all of these fiber types would be suitable for use in embodiments where the braided body is to be stretched.

It should also be understood that all references herein to the term "ultra-high" with regard to the molecular weight of the polyolefins or polyethylenes of this disclosure is not intended to be limiting at the maximum end of polymer viscosity and/or polymer molecular weight. The term "ultra-high" is only intended to be limiting at the minimum end of polymer intrinsic viscosity and/or polymer molecular weight to the extent that useful polymers within the scope of the disclosure are capable of being processed into fibers having the desired properties described herein. It should also be understood that while the processes described herein are most preferably applied to the processing of UHMW polyethylene, they are equally applicable to all other poly(alpha-olefins), i.e. UHMW PO polymers.

The elongate bodies of this disclosure may be useful in a range of end applications, such as sash cords, water ski ropes, mountaineering ropes, yachting ropes, parachute lines, fishing nets, mooring lines, hawsers, shoe laces, medical applications such as catheters or dental floss, high-pressure tubes, ground cables and harnesses, but are particularly useful in applications requiring improved cyclic bend over sheave (CBOS) fatigue resistance as discussed above, including marine applications such as lifting and mooring heavy objects from the seabed.

CBOS resistance may be tested, for example, by bending ropes of this disclosure approximately 180 degrees over a free rolling sheave or pulley. The ropes are placed under load and cycled over the sheave until the rope reaches failure. In an exemplary test, a rope is bent over a 38 mm diameter sheave/pulley wherein the D:d ratio (D=the diameter of the sheave/pulley, d=the diameter of the rope) is 20 at 56 cycles per minute, with a 156 kg load on the sheave/pulley (78 kg of tension on each side of the rope). The number of cycles-to-failure is typically averaged, e.g., determined based on an average of 3 to 5 tests.

Particularly excellent CBOS fatigue resistance have been achieved for multi-fiber elongate bodies (ropes) comprising a plurality of multi-filament ultra-high molecular weight polyolefin fibers having a filament intrinsic viscosity ($IV_f$) of from 15 dl/g to about 45 dl/g (as measured in decalin at 135° C.), wherein each multifilament ultra-high molecular weight polyolefin fiber has a tenacity of at least 32 g/denier, a denier of greater than 800, wherein each of the filaments has a denier (dpf) of at least 2.0 and wherein the ratio of $IV_f$ (in dl/g) to dpf ("$IV_f$/dpf") is from 4.0:1 up to 8.0:1, inclusive of all narrower ranges between said end points, such as 4.1 to 7.5 and from 4.2 to 7.0. In the preferred embodiment, it is also most preferred that the product of the dpf multiplied by the $IV_f$ (in dl/g) ("$IV_f$*dpf") is at least 75.0, more preferably wherein the product of the dpf multiplied by the $IV_f$ is from at least 75.0 up to 110.0, inclusive of all narrower ranges between said end points, such as from 80.0 up to 105.0, or from 85.0 up to 100.0, or from 88.0 up to 95.0. The most preferred polyolefin fiber types satisfy both of these values $IV_f$*dpf and $IV_f$/dpf values. In one exemplary embodiment, a multi-fiber elongate body is formed wherein each multifilament fiber of the elongate body has a denier of about 1600 and comprises 480 filaments (i.e., a dpf of 3.33), wherein the filaments have an $IV_f$ of about 22.6 dl/g up to about 26.5 dl/g. Therefore, in this exemplary embodiment, the $IV_f$*dpf value ranges from 75.3 to 88.2, and the $IV_f$/dpf value ranges from 6.79 to 7.96.

It is also within the scope of this disclosure that multi-fiber elongate bodies (ropes) may also comprise one or more highly oriented polyolefin multifilament fibers having a tenacity of 45 g/d or greater, for example, from 45 g/denier to about 60 g/denier, without the component filaments of such multifilament fibers necessarily having a dpf of 2.0 or greater or a denier of 800 or more, provided that at least one polyolefin fiber in the rope satisfies the above-stated features of $IV_f$*dpf (i.e., at least 75.0 up to 110.0) and/or $IV_f$:dpf ratio ($IV_f$/dpf) (i.e., from 4.0:1 up to 8.0:1).

The following non-limiting examples serve to illustrate the preferred embodiments:

Example 1

A spinning solvent and a UHMW PE polymer were mixed to form a slurry inside of a slurry tank that is heated to 100° C. The UHMW PE polymer had an intrinsic viscosity $IV_0$ of about 30 dl/g. A solution was formed from the slurry by heating it to at least the melting point of the UHMW PE polymer. The concentration of the polymer in the slurry was about 7%. After forming a homogenous spinning solution, the solution was spun through a 360-hole spinneret to form a multi-filament solution fiber. The holes of the spinneret have diameters of about 1 mm and Length/Diameter (L/D) ratios of 15:1. The solution fiber was then passed through a 1.5 inch (3.8 cm) long air gap and into a water quench bath having a water temperature of about 10° C. to form a gel fiber. The solution fiber was stretched in the 1.5-inch air gap at a draw ratio of about 1.5:1 and the gel yarn was cold stretched with sets of rolls at a 5.5:1 draw ratio before entering into a solvent removal device. In the solvent removal device, wherein the solvent was extracted with an extraction solvent, the gel fiber was drawn at about a 1.4:1 draw ratio. The resulting dry fiber, which had a fiber $IV_f$ of 20 dl/g, was drawn by multiple sets of rollers to form a partially oriented fiber having a tenacity of about 24.5 g/denier. The partially oriented fiber was then drawn at about 150° C. within a 22-meter oven with a feed speed of the fiber of about 12 meter/min and with the take up speed at about 31 m/min, to thereby form a highly oriented fiber having a tenacity of above 32 g/d and with the fiber having a denier of 1600 and a denier per filament (dpf) of 4.4, with the fiber $IV_f$ remaining at 20 dl/g.

Twelve of these highly oriented fibers were then braided together according to conventional braiding techniques to form a rope having a denier of about 20,000.

Example 2 and Comparative Examples 1-4

Five identical braid constructions having length:diameter (L:D) ratios of 10:1 were formed by braiding together 12 ultra-high molecular weight polyethylene fibers having the properties listed in Tables 1 and 2 below. No coatings were applied to the component fibers or braids. Bending cycles to failure were determined by continuous cycling of the braids at 56 bend cycles per minute over a 38 mm sheave at a load of 78 kg on each end of the specimen.

TABLE 1

| Ex. # | Fiber | Fiber Denier | Fila-ments | dpf | IV (dl/g) | IV*dpf | IV:dpf |
|---|---|---|---|---|---|---|---|
| 2 | New | 1635 | 360 | 4.5 | 19.9 | 90 | 4.4:1 |
| Comp. 1 | UHMWPE 1 | 1570 | 360 | 4.4 | 16.5 | 72 | 3.8:1 |
| Comp. 2 | UHMWPE 2 | 1589 | 240 | 6.6 | 16.8 | 111 | 2.5:1 |
| Comp. 3 | UHMWPE 3 | 1566 | 720 | 2.2 | 18.0 | 39 | 8.3:1 |
| Comp. 4 | UHMWPE 4 | 1542 | 720 | 2.1 | 18.2 | 39 | 8.5:1 |

TABLE 2

| Ex. # | Fiber | Fiber Tenacity (g/denier) | Fiber Modulus (g/denier) | Braid Denier | CBOS CTF |
|---|---|---|---|---|---|
| 2 | New | 34.1 | 1309 | 20630 | 155131 |
| Comp. 1 | UHMWPE 1 | 35.8 | 1327 | 20061 | 104966 |
| Comp. 2 | UHMWPE 2 | 33.8 | 1102 | 19846 | 96454 |
| Comp. 3 | UHMWPE 3 | 34.7 | 1255 | 19960 | 37673 |
| Comp. 4 | UHMWPE 4 | 35.2 | 1279 | 20078 | 16508 |

As shown by the CBOS testing, braids formed from the new fibers had a substantially improved abrasion resistance and durability compared to other fiber types, particularly compared to those not meeting the recited requirements for IV:dpf ratio and the IV*dpf product value.

While the present disclosure has been particularly shown and described with reference to preferred embodiments, it will be readily appreciated by those of ordinary skill in the art that various changes and modifications may be made without departing from the spirit and scope of the disclosure. It is intended that the claims be interpreted to cover the disclosed embodiment, those alternatives which have been discussed above and all equivalents thereto.

What is claimed is:

1. An elongate body comprising a plurality of fibers, wherein at least one of said fibers comprises a multifilament ultra-high molecular weight polyolefin fiber having a filament intrinsic viscosity ($IV_f$) of from 15 dl/g to about 45 dl/g when measured in decalin at 135° C., wherein said at least one multifilament ultra-high molecular weight polyolefin fiber has a tenacity of at least 32 g/denier, a denier of greater than 800, and a denier per filament of greater than 2.0.

2. The elongate body of claim 1 wherein all of the fibers forming said elongate body comprise multifilament ultra-high molecular weight polyolefin fibers having an $IV_f$ of from 15 dl/g to about 45 dl/g when measured in decalin at 135° C., a tenacity of at least 32 g/denier, a denier of 900 or greater, and a denier per filament of greater than 2.0, wherein the elongate body is a rope.

3. The elongate body of claim 1 wherein the elongate body is a rope and wherein all of the fibers forming said elongate body have a denier of 1600 or greater.

4. The elongate body of claim 1 wherein the elongate body is a rope and wherein said elongate body has a denier of greater than 2300.

5. The elongate body of claim 1 wherein the elongate body is a rope and wherein said elongate body has a denier of greater than 3000.

6. The elongate body of claim 1 wherein all of the fibers forming the elongate body are polyolefin fibers and wherein the elongate body comprises from 3 to 40 discrete, unfused fibers.

7. The elongate body of claim 1 wherein all of the fibers forming the elongate body are polyethylene fibers.

8. The elongate body of claim 1 wherein the elongate body is a rope and wherein said plurality of fibers are braided together or braided together and twisted.

9. The elongate body of claim 1 wherein the ratio of $IV_f$ to denier per filament is from 4.0:1 up to 8.0:1.

10. An elongate body comprising at least one multifilament fiber that comprises an ultra-high molecular weight polyolefin fiber formed from a plurality of ultra-high molecular weight polyolefin filaments, said ultra-high molecular weight polyolefin filaments having a filament intrinsic viscosity ($IV_f$) of from 15 dl/g to about 45 dl/g when measured in decalin at 135° C., wherein said multifilament ultra-high molecular weight polyolefin fiber has a denier of greater than 800 and wherein each of the filaments of said multifilament ultra-high molecular weight polyolefin fiber has a denier of at least 2.0, wherein the product of the denier per filament of said filaments multiplied by the $IV_f$ of said filaments is from 75.0 to 110.0.

11. The elongate body of claim 10 wherein the product of the denier per filament multiplied by the $IV_f$ is from 85.0 to 110.0.

12. The elongate body of claim 10 wherein the ratio of $IV_f$ to denier per filament is from 4.0:1 up to 8.0:1.

13. The elongate body of claim 10 wherein the elongate body is a rope and wherein each multifilament fiber has a denier of about 1600 and comprises at most 480 filaments, and wherein the filaments have an $IV_f$ of about 20 dl/g or more.

14. The elongate body of claim 10 wherein the elongate body is a rope and wherein each multifilament fiber has a denier of about 1600 and comprises at most 760 filaments, and wherein the filaments have an $IV_f$ of at least about 25 dl/g or more.

15. The elongate body of claim 10 wherein the ratio of $IV_f$ to denier per filament is from 4.0:1 up to 8.0:1, wherein the product of the denier per filament multiplied by the $IV_f$ is at least 75.0, wherein all of the fibers forming said elongate body have a denier of at least 900, wherein said elongate body has a denier of at least 2300, and wherein the elongate body is a rope and wherein the plurality of multifilament fibers are combined in a twisted construction, in a braided construction, or a combination thereof.

16. A method of making an elongate body comprising the steps of:

a) providing a plurality of fibers, wherein at least one of said fibers comprises a multifilament ultra-high molecular weight polyolefin fiber having a filament intrinsic viscosity ($IV_f$) of from 15 dl/g to about 45 dl/g when measured in decalin at 135° C., wherein said at least one multifilament ultra-high molecular weight polyolefin fiber has a tenacity of less than 32 g/denier, a denier of greater than 800, and a denier per filament of greater than 2.0;

b) stretching each multifilament fiber to thereby increase the tenacity of the fibers to at least 32 g/denier, wherein the denier per filament remains greater than 2.0;

c) optionally coating at least a portion of each fiber with either a thermoplastic resin or an oil;

d) twisting, entangling and/or braiding the fibers to form an elongate body structure; and e) optionally heating and stretching the elongate body structure to heat set the fibers of said elongate body.

17. The method of claim 16 wherein all of said fibers forming the elongate body are polyethylene fibers.

18. The method of claim 16 wherein the elongate body is a rope and wherein said fibers are combined in a twisted construction, in a braided construction, or a combination thereof.

19. The method of claim 18 wherein the elongate body comprises from 8,000 to about 26,000 multifilament fibers.

20. The method of claim 18 wherein the ratio of $IV_f$ to denier per filament is from 4.0:1 up to 8.0:1 and wherein said elongate body has a denier of greater than 2700.

* * * * *